US005382212A

United States Patent [19]

Davenport et al.

[11] Patent Number: 5,382,212

[45] Date of Patent: Jan. 17, 1995

[54] CONSTANT FORCE LOAD FOR AN EXERCISING APPARATUS

[75] Inventors: Bruce Davenport, Bowen Island; James A. McArthur, Surrey, both of Canada

[73] Assignee: **Med*Ex Diagnostics of Canada, Inc.**, British Columbia, Canada

[21] Appl. No.: 184,307

[22] Filed: Jan. 21, 1994

Related U.S. Application Data

[63] Continuation-in-part of Ser. No. 943,912, Sep. 11, 1992, abandoned.

[51] Int. Cl.[6] ..... A63B 21/04

[52] U.S. Cl. ..... 482/123; 482/121; 482/129; 482/130

[58] Field of Search ..... 482/121, 122, 123, 127, 482/128, 129, 130, 138, 137

[56] References Cited

U.S. PATENT DOCUMENTS

| | | | |
|---|---|---|---|
| 4,231,568 | 11/1980 | Riley et al. . | |
| 4,643,420 | 2/1987 | Riley et al. | 482/130 |
| 4,809,972 | 3/1989 | Rasmussen et al. . | |
| 5,005,831 | 4/1991 | Hara | 482/129 |
| 5,042,799 | 8/1991 | Stanley . | |

*Primary Examiner*—Richard J. Apley
*Assistant Examiner*—Lynne A. Reichard
*Attorney, Agent, or Firm*—Vinson & Elkins

[57] ABSTRACT

A constant force load for use in an exercising apparatus. The load includes a frame, an energy storage unit coupled to the frame and capable of exerting a force on an external element when storing energy therein, a cam for making the force transmitted from that exerted by the energy storage means constant, and force transmission means for changing the constant transmitted force. The load further includes an output force modifying assembly for making the output force constant.

7 Claims, 3 Drawing Sheets

CONSTANT FORCE LOAD FOR AN EXERCISING APPARATUS

This application is a continuation-in-part of copending application Ser. No. 07/943,912, filed Sept. 11, 1992, now abandoned.

BACKGROUND

The present invention relates to a constant force load for use in exercising apparatus.

Most conventional exercise machines use weights and the force of gravity to provide a load to the muscles of a user. Our bodies can easily minimize the beneficial effects on the muscles of such a load by simply providing it with a large initial acceleration or impulse and then largely controlling the movement thereafter without applying a force sufficient to benefit the muscles through much of the range of movement of the exercise. The basic reason for being able to move the weights in this manner is due to the fact that the kinetic energy imparted to the weights by the initial impulse lessens the force required to move the weight through the remaining part of the exercise. Consequently, studies have shown that when using weights in combination with the force of gravity as the muscle load, one must load the muscle to at least 80% of its capacity in order to effectively exercise the non-elastic component of that muscle and gain both strength and muscle size.

Accordingly, it is an object of the invention to provide a load having a high acceleration capability. It is a further object of the invention to provide an adjustable load which, once adjusted, provides a constant force.

SUMMARY OF THE INVENTION

According to the invention there is provided a constant force load for use in an exercising apparatus.

The apparatus includes a frame, spring means for providing a force load, cam means for making the force load exerted by the spring means constant and force transmission means for changing the magnitude of the force transmitted from the cam means. A point of load attachment is coupled to the force transmission means and is movable with respect to the force transmission means so as to change the magnitude of the force at an output thereof. The spring means and the point of load attachment move together relative to the force transmission means.

The force transmission means may comprise a lever having a pivot axis at one end, a point of load attachment intermediate the pivot axis and an end remote from the one end and means for obtaining an output force from the lever.

The pivot axis of and the point of load attachment to the lever may be adjustable.

The output force obtaining means may be a cam rigidly affixed to the lever so as to rotate about a pivot axis thereof as the lever pivots and shaped to make the output force thereof constant.

Advantageously, the point of load attachment is continuously adjustable along the lever.

The point of load attachment is, preferably, adjustable so that its distance from the pivot axis in a direction along the lever length may be adjusted down to zero.

Other types of spring means may also be used such as an elastomeric mass or elastomeric bands or even weights. Utilizing a spring as the load minimizes the inertia or momentum in the apparatus and features a high acceleration so that a user's muscles are fully loaded throughout the entire range of movement of an exercise.

A lever provides a simple and inexpensive but elegant means for achieving an adjustable mechanical advantage ranging continuously from zero up to unity.

The device provides a system for achieving an adjustable constant force adjustable in infinitely small steps from zero load up to a relatively high load value depending on the capacity of the spring. The device has a low inertia and high acceleration capability, with the acceleration being higher the higher the constant force. No power is required to generate the resistance.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
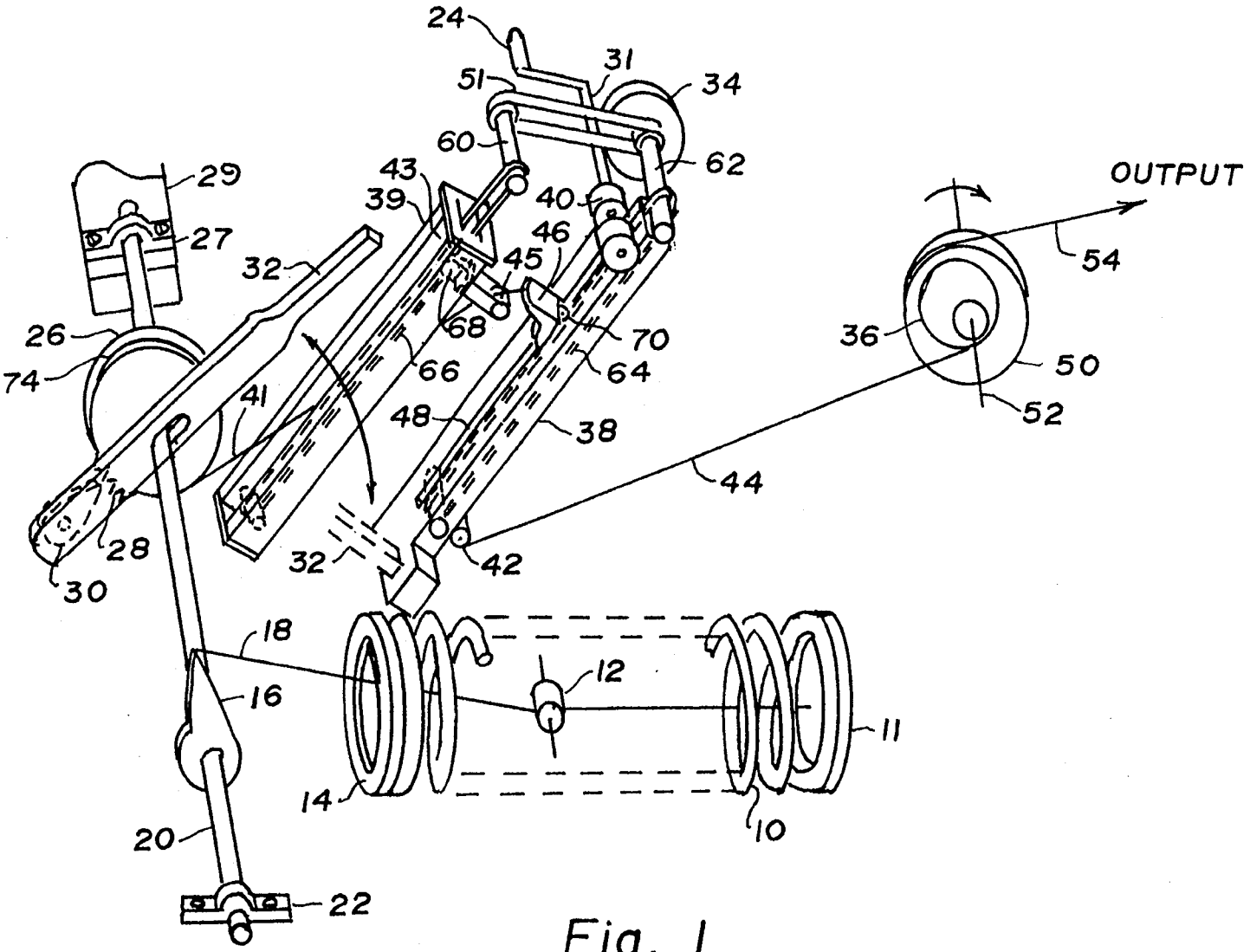
FIG. 1 is a schematic perspective view of the lever force transmission assembly.

Referring to FIG. 1 there is shown in perspective a lever force transmission assembly consisting of a large spring 10 as the source of resistance. The spring 10 is compressed by means of a cable 18 affixed at one end 11 of the spring 10. The term cable is used but it is understood that any flexible line would do such as chain, rope, etc. The other end of cable 18 is attached to a cam 16 and passes through a central opening in fixed end 14 of spring 10. Fixed end 14 is attached to a frame 29. Cam 16 is affixed to shaft 20 which is rotatable in bushings 22 and 27 coupled at either end of the shaft 20. Idler pulley 12 ensures that cable 18 pulls perpendicularly to end 11 of spring 10. Cam 16 is shaped so that the spring 10 and cam 16 combination produces a constant resistive torque when shaft 20 is rotated.

A flexible connector 41 is wound around pulley 26 which is rotatable around shaft 20. A torsion spring 74 has one end connected to pulley 26 and the other to shaft 20 biasing the pulley 26 in a direction so as to tension connector 41. Pulley 26 has a plurality of teeth 28 around a portion of a periphery thereof. A pawl 30 affixed to a long shaft 32 removably engages the teeth 28 as shaft 32 slides over shaft 20. Thus, as shaft 20 rotates, shaft 32 and pawl 30 also rotate. The distal end of shaft 32 abuts lever 38 when the latter is in its rest position, as shown in phantom, and causes pawl 30 to disengage from teeth 28. Once disengaged, torsion spring 74 acting on pulley 26 causes the latter to rotate and take up any slack in flexible connector 41.

At its other end flexible connector 41 passes over idler 45 and is affixed to lever bracket 46. Idler 45 is coupled to a drive chain 66 which causes it to slide along open track 43 of fixed member 39. Fixed member 39 has both ends affixed to a frame 29. Lever bracket 46 is attached at 70 to chain 64 driven along track 48 by gear 62. Similarly, idler 45 is attached at 68 to chain 66 and is driven along slot 43 by gear 60 which drives chain 66. Worm gear 31 driven by crank 24 couples to gear 34. Gear 34 is coupled directly to gear 62 and is coupled by chain 51 to gear 60. The gear ratios are such that operation of crank 24 serves to simultaneously drive chains 64 and 66 so that they track one another. Lever 38 pivots about rollers 40 the axis of which forms the axis of rotation of lever 38. Worm gear 31 is axially aligned with rollers 40 so that pivoting of arm 38 does not require any movement of gear 31 and crank 24. Bracket 46 and idler 45 are movable through split rollers 40 to the axis of rotation of the rollers 40 and the lever 38.

An output cable 44 is affixed to a distal pivotal end of lever 38 at an attachment point 42 and at the other end is wound around an output cam 36. Cam 36 is affixed to pulley 50 and the output is taken on line 54 wound on pulley 50. Pulley 50 has a constant radius with respect to its center of rotation 52 and gears down the torque produced by cam 36. Cam 36 is shaped so that its radius to the point where it is contacted by cable 44 varies so as to compensate for the change in angle of lever 38 with respect to cable 44 and to a lesser extent for the change in angle between flexible connector 41 and lever 38.

Adjustment of the position of both idler 45 and lever bracket 46 by means of the worm gear 31, gear 34 and gears 60 and 62, causes the lever arm length for the resistive force from the spring 10 to change and, therefore, for the mechanical advantage of the lever 38 to change.

The assembly of FIG. 1 can be used to replace a series of discrete weights commonly used on weight machines by providing a low-inertia, constant-torque resistance. The load is adjustable from zero to a very large value depending on the spring characteristics. The torque resistance on pulley 50 is substantially constant as it is moved through its full range. Although a coil spring 10 is shown as a preferred load source, other load sources such as a resilient mass, or even a large weight could be used.

Figure 2:
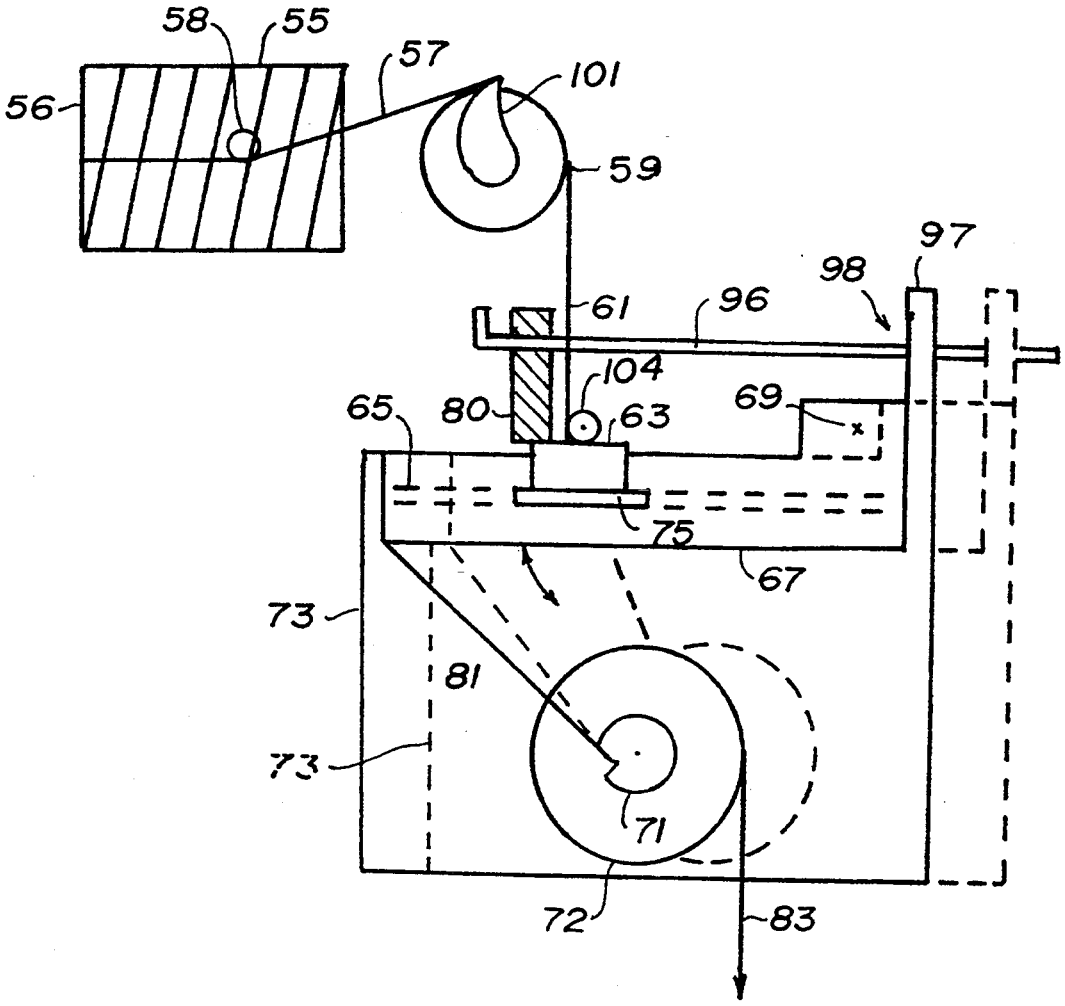
FIG. 2 is an elevation view of an alternative embodiment of the invention.

Referring to FIG. 2 there is shown an alternative embodiment of the invention which also employs a large coil spring 55 having an end plate 56 with a cable 57 attached centrally thereto. Cable 57 winds partially around pulley 58 and is attached to an end of cam 101. Cam 101 is shaped so that a constant tension in line 61 independent of the deflection of spring 55 is produced via pulley 59. Cable 61 winds partly around idler pulley 104 which is rotatably mounted to slide mount 63 and attaches to mount 63. Mount 63 is positioned in a fixed lateral position relative to a first frame assembly 80. A pivotal arm 67 is pivotal about pivot 69 and has slots 65 which engage lower plate 75 of mount 63 when pivoting counterclockwise from the rest position shown. Cable 81 is attached to a distal end of lever 67 at one end and at the other end is attached cam 71. Cam 71 is affixed to pulley 72 around which output line 83 is wound. Cam 71 compensates for the change in angle between cable 81 and lever 67 and to a lesser extent for the change in angle between cable 61 and lever 67 as lever 67 pivots.

Lever 67, pulley 72 and cam 71 are all mounted on frame 73 while spring 55, pulley 59, cam 101 and mount 63 are all mounted on frame 80. Frame 73 is movable laterally with respect to frame 80 by means of a lead screw 96 passing through and rotatable with respect to frame 80 and threadedly registering with a threaded hole 98 in extension 97 of frame 73. As frame 73 moves to the right, lever 67 slides over plate 75 changing the distance between pivot 69 and mount 63. Because the slide mount 63 and idler pulley are fixed relative to pulley 59, changing the position of the mount 63 relative to lever 67 does not create any slackness in the line 61 which requires tensioning.

Operationally, force applied to output line 83 causes cam 71 to tension line 81 and pivot lever 67. Lever 67 acts on plate 75 of mount 63 and pivots the latter downwardly in a counterclockwise direction relative to pivot 69. Cable 61 is pulled downwardly rotating pulley 59 and, hence, cam 101, clockwise. Cable 57 is pulled to the right compressing spring 55. The action of cams 101 and 71 in compensating for spring deflection and changing angle between lever 67 and attached cables 61 and 81, respectively produces a constant output load on line 83 which is infinitely, continuously adjustable.

Figure 3:
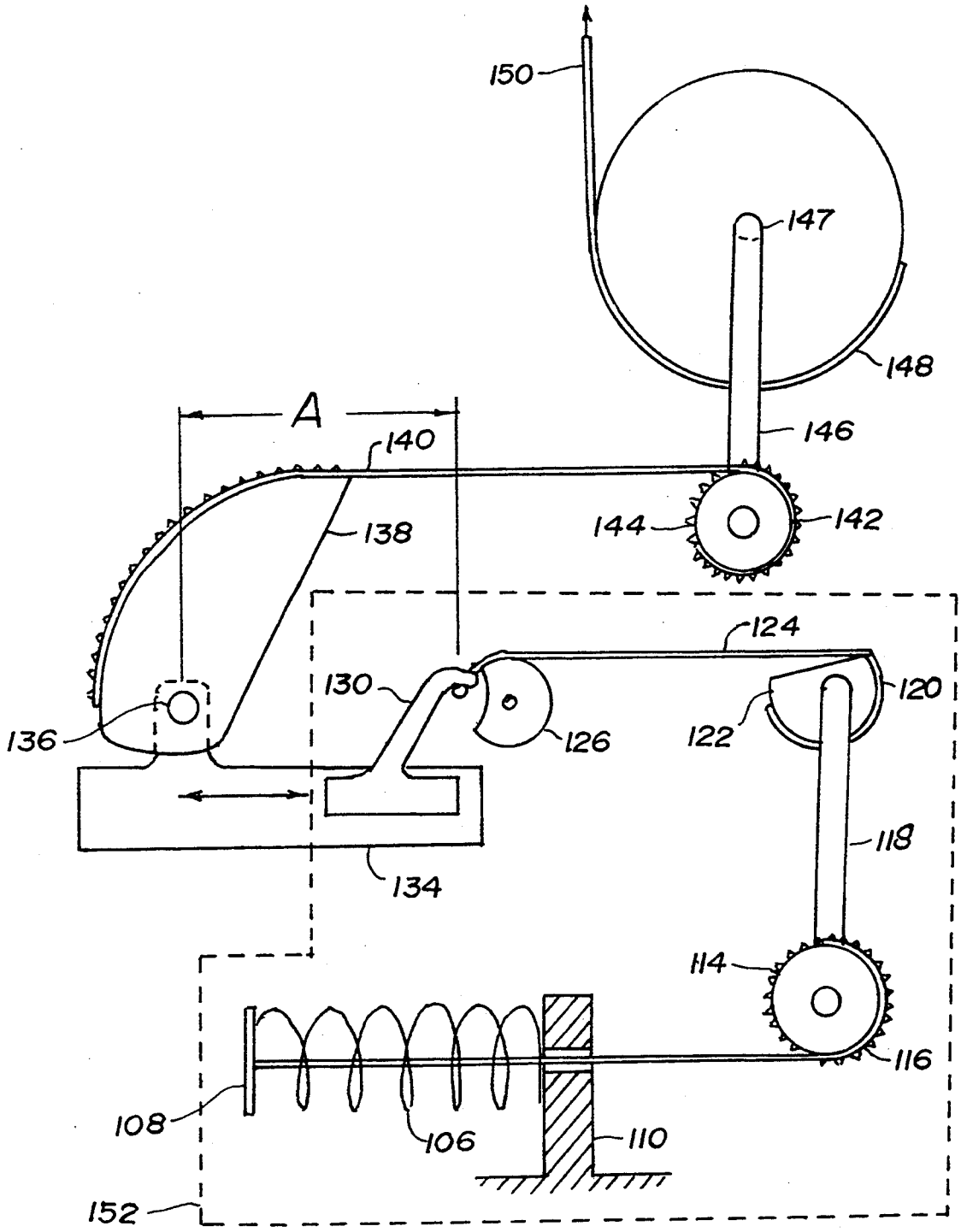
FIG. 3 is an elevation view of yet another alternative embodiment of the invention.

Although the embodiments of FIGS. 1 and 2 are useful, an even more preferred embodiment is shown in FIG. 3. In this case a coil spring 106 is compressed between a stop 110 and a backing plate 108 by tensioning of chain 112. Chain 112 is looped around sprocket 114. Sprocket 114 is rigidly connected to cam 122 on shaft 118. Cam 122 is shaped so as to compensate for the increasing spring force with compression so as to make the tension on cable 124 looped around the cam 122 constant with changes in deflection of the spring 106. A pin 128 on the end of cable 124 after the latter passes over idler pulley 126 interconnects with bracket 130. Bracket 130 is adjustable along the length of lever 134 from a point near the distal end thereof to a point where pin 128 is aligned with axis 136. As bracket 130 is moved along lever 134, the subframe 152 to which pulleys 126, 122 and 114, spring 106, and stop 110 are all mounted move together with bracket 130 so that no slack in cable 124 is developed.

Rigidly affixed to lever 134 is a cam 138 shaped so as to compensate for the variation in force due to the varying angle between cable 124 and lever 134 as the latter moves clockwise. Chain 140 looped around and affixed to a periphery of cam 138 also loops around sprocket 144. Sprocket 144 is rigidly connected to pulley 148 on shaft 146. Cable 150 looped around pulley 148 is the cable to which user force is applied.

The operation of the embodiment of FIG. 3 is similar to that of FIG. 2. A user pulls on cable 150 wound around pulley 148 with a constant force independent of the length of cable 150 pulled from around pulley 148. Movement of pulley 148 causes sprocket 147 to rotate and turn sprocket 142 and, hence, pulley 144. Rotation of pulley 144 causes cable 140 to pull cam 138 clockwise. Lever 134, which is rigidly affixed to cam 138, is also caused to rotate clockwise and pull bracket 130 clockwise. Bracket 130 pulls on pin 128 and draws cable 124 to the left causing counter clockwise rotation of cam 122 and, hence, of sprocket 120. Counter clockwise rotation of sprocket 120 causes counter clockwise rotation of sprocket 116 and pulley 114. Such rotation of pulley 114 causes cable 112 to pull on backing plate 108 and compress spring 106.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

We claim:

1. A constant force load apparatus for an exercising device, comprising:

(a) a frame;

(b) spring means for providing a force load;

(c) cam means for making the force load exerted by said spring means constant;

(d) force transmission means for changing the magnitude of the force transmitted from said cam means;

(e) a point of load attachment coupled to said force transmission means movable with respect to said force transmission means so as to change the magnitude of the force at an output thereof;

wherein said spring means and said point of load attachment move together relative to said force transmission means.

2. Apparatus according to claim 1, wherein said force transmission means is a lever having a lever arm, a pivot axis and wherein the point of load attachment is movable along said lever arm.

3. Apparatus according to claim 1, wherein said point of load attachment is continuously adjustable along said lever down to a position where the lever arm has zero length.

4. Apparatus according to claim 1, wherein said cam means is a cam coupled to said spring means and wherein a transmission cam is coupled to said force transmission means output and is shaped so as to make the output force thereof constant and means is a spring coupled to said frame.

5. A constant force load apparatus for an exercising device, comprising:

(a) a frame;

(b) a spring;

(c) a transmission coupled to said frame having a lever pivotal about an axis proximate one end from a rest position and a load attachment means coupled to said spring, said load attachment means being intermediate said one end and a remote end of said lever with the distance between the axis and said load attachment means being adjustable;

(d) a spring cam coupled to said spring shaped so as to convert the resistive load provided by said spring to a constant resistive load independent of spring deflection;

(e) a lever cam coupled to said lever and shaped so as to convert an output load from said transmission to a constant output load independent of lever deflection; and (f) means for taking up the slack in said cable due to changes in the position of said load attachment means.

6. Apparatus according to claim 5, wherein said slack taking up means comprises a subframe coupled to said spring and said load attachment means and movable relative to said transmission and said frame so as to avoid slack in the connection between said load attachment means and said spring.

7. Apparatus according to claim 5, wherein said means for taking up the slack includes means for moving said point of load attachment, said spring and said spring cam together.

* * * * *

UNITED STATES PATENT AND TRADEMARK OFFICE

CERTIFICATE OF CORRECTION

PATENT NO : 5,382,212

DATED : January 17, 1995

INVENTOR(S) : Davenport et al.

It is certified that error appears in the above-identified patent and that said Letters Patent is hereby corrected as shown below:

At column 1, after line 48, insert, as a new paragraph: --Preferably the energy storage unit is a spring. --

In claim 4, at column 5, line 32, after "constant and", insert --said spring--.

Signed and Sealed this

Twenty-third Day of June, 1998

*Attest:*

*Attesting Officer*

BRUCE LEHMAN

*Commissioner of Patents and Trademarks*